United States Patent [19]

Jacobsson

[11] Patent Number: 4,860,558

[45] Date of Patent: Aug. 29, 1989

[54] MONITORING CIRCUIT FOR A KNITTING MACHINE

[75] Inventor: Kurt A. G. Jacobsson, Ulricehamn, Sweden

[73] Assignee: Aktiebolaget IRO, Ulricehamn, Sweden

[21] Appl. No.: 165,272

[22] PCT Filed: Jun. 25, 1987

[86] PCT No.: PCT/EP87/00336

§ 371 Date: Feb. 26, 1988

§ 102(e) Date: Feb. 26, 1988

[87] PCT Pub. No.: WO88/00257

PCT Pub. Date: Jan. 14, 1988

[30] Foreign Application Priority Data

Jun. 26, 1986 [DE] Fed. Rep. of Germany ..... 3621428

[51] Int. Cl.[4] ..... D04B 35/12; D04B 35/14

[52] U.S. Cl. ..... 66/163; 340/677

[58] Field of Search ..... 66/125 R, 132 R, 132 T, 66/163, 161; 340/677, 691

[56] References Cited

U.S. PATENT DOCUMENTS 3,321,755 5/1967 Cooke ..... 66/163 X 3,343,158 9/1967 Tellerman ..... 66/163

3,379,037 4/1968 Antonevich ..... 66/163

3,952,554 4/1976 Kerff ..... 66/163

4,307,389 12/1981 Slotkowski ..... 340/661

FOREIGN PATENT DOCUMENTS 2458884 7/1975 Fed. Rep. of Germany ..... 66/163

*Primary Examiner*—Wm. Carter Reynolds

*Attorney, Agent, or Firm*—Flynn, Thiel, Boutell & Tanis

[57] ABSTRACT

A monitoring circuit for a knitting machine with at least one yarn feeding arrangement comprises two yarn monitoring devices which are provided with switches and connected via a first rectifier circuit and an indicating lamp to a supply line. The supply line is coupled to a supply voltage source in such a way that when one of the two yarn monitoring devices is operated, the indicating lamp is only activated by one half-wave which is associated with the yarn monitoring devices and belongs to an a.c. voltage signal generated by the supply voltage source. To improve the recognizability of an indication by the indicating lamp, the a.c. voltage signal generated by the supply voltage source has a first interval during which the signal has exclusively positive half-waves and a second interval during which the signal has exclusively negative a.c. voltage half-waves.

10 Claims, 1 Drawing Sheet

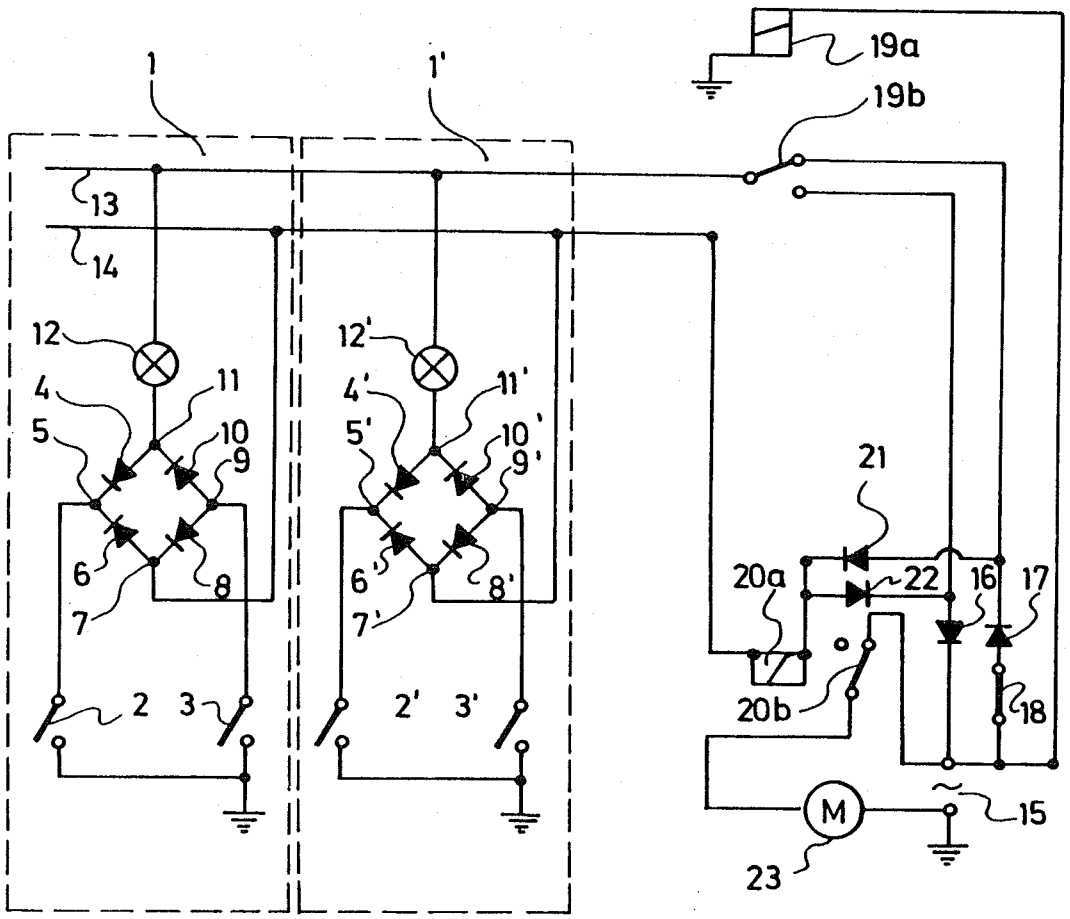
19a
19b
1'
1
13
14
12'
12
11'
11
10'
10
9'
9
8'
8
4'
4
5'
5
6'
6
7'
7
2'
2
3'
3
17
18
16
15
22
21
20a
20b
M
23

MONITORING CIRCUIT FOR A KNITTING MACHINE

FIELD OF THE INVENTION

This invention relates to a monitoring circuit for a knitting machine.

This invention relates especially to an improvement for the fault indication for a knitting machine or textile machine comprising a plurality of yarn feeding devices as shown in U.S. Pat. No. 3,952,554.

BACKGROUND OF THE INVENTION

In the known monitoring circuit according to U.S. Pat. No. 3,952,554 two yarn monitoring means are provided in each yarn feeding device. One of the two yarn monitoring means monitors the supplied yarn and is designated as the ingoing yarn monitoring means while the other of said two yarn monitoring means monitors the discharged yarn and is designated as the outgoing yarn monitoring means. The ingoing yarn monitoring means is operated when there is yarn breakage on the entry side or excessive tension of the ingoing yarn. The outgoing yarn monitoring means serves to detect yarn breakage on the discharge side, as well as a tension of the outgoing yarn which is too low, as occurs, for instance, when there is excessive yarn speed.

The two switches are in communication with a supply line via oppositely directed diodes of a first rectifier circuit and via an indicating lamp which is mounted on each yarn feeding device. The supply line is connected to an a.c. voltage source. When one of the two yarn monitoring means of a yarn feeding device is responsive, the corresponding switch is closed so that the rectifier diode of the first rectifier circuit which is associated with this switch is grounded via the switch. A current of half-wave shape respectively flows from the supply line via the indicating lamp and the rectifier diode toward ground during the half-wave of the a.c. voltage signal which is applied to the supply line for which the rectifier diode is conductive. Hence, when only one of the two yarn monitoring means is responsive, the indicating lamp is excited with current having a.c. voltage half-waves of only one polarity. However, when both yarn monitoring means are responsive at the same time, the indicating lamp is triggered with an a.c. voltage signal comprising both half-waves. The indicating lamp is dimensioned for this fault case in which it is triggered with the maximum current. This, however, has the result that when there is a usual fault case in which only one of the two yarn monitoring means is responsive, a relatively weak light signal is outputted by the indicating lamp. This makes it relatively difficult for the operator of the textile machine or knitting machine to locate that yarn feeding device in which the fault occurred, which in the final analysis led to the disconnection of the entire textile machine or knitting machine. It is difficult to detect the yarn supplying device which is failing, especially in textile machines or knitting machines of the type which is now in use and includes up to 144 yarn feeding devices. Moreover, the operator cannot judge by the light signal outputted by the indicating lamp whether a defect occurred in the respective yarn feeding device on the entry side, the discharge side or on the entry and discharge sides at the same time.

In view of this state of art, the present invention is based on the object of developing a monitoring circuit of the above-mentioned kind in such a way that the fault indication is improved by the indicating lamp of the yarn feeding device.

SUMMARY OF THE INVENTION

The objects and purposes of the invention, including those set forth above, are met by providing a monitoring circuit which includes at least one yarn feeding device having two yarn monitoring arrangements, each provided with a switch. The switches are connected to a supply voltage arrangement via a rectifier circuit and an indicating lamp. The supply voltage arrangement provides a signal which cooperates with the two switches and the rectifier circuit to activate the indicating lamp when at least one of the yarn monitoring arrangements indicates a malfunction. During first time intervals, the signal has exclusively positive voltage half-waves, and during second time intervals the signal has exclusively negative voltage half-waves. The first and second time intervals differ in length.

Owing to the fact that the a.c. voltage signal outputted by the supply voltage source has exclusively positive a.c. voltage half-waves during a first interval and exclusively negative a.c. voltage half-waves during a second interval, the indicating lamp can be dimensioned such that when one yarn monitoring means is operated, it already outputs the maximum permissible light power. The monitoring circuit of this invention accomplishes a flashing alarm display when the yarn monitoring means of the yarn feeding device on either the entry side or the discharge side is responsive. However, when both yarn monitoring means are simultaneously responsive, a constant, continuous light signal appears. When the two intervals are suitably, i.e. differently, fixed, it can be seen from the flash duration whether a fault occurred on the entry or discharge side. In other words, the kind of the occurring fault can be shown through different bright-dark time ratios during the first interval as compared to the ratios during the second interval. Moreover, the light signal outputted by the indicating lamp can be more easily seen than a continuous indicating light, especially when this lamp is within the incidence of daylight.

Moreover, the monitoring circuit of the invention has the advantage that monitoring circuits which already exist can be easily rebuilt to attain the advantages described above. The electrical modifications as compared to the known monitoring circuit are merely within the control of the knitting machine while the individual circuits associated with the yarn feeding devices can remain unchanged. In view of the great number of yarn feeding devices used, this is of importance to practice.

A preferred development of the supply voltage source includes an a.c. voltage source, first and second rectifier elements which are of opposite polarity and connected to the a.c. voltage source, and a periodically operated switch which alternately connects the rectifier elements to the supply line.

By connecting one of the two rectifier elements to the a.c. voltage source via a manual switch, the invention makes it possible to selectively disable one of the two yarn monitoring arrangements of the yarn feeding devices.

A further development includes a second rectifier circuit connected to the switches and coupled via a fault signal line to a knitting machine locking relay. The locking relay is connected across third and fourth rectifier elements to the first and second rectifier elements. This development accomplishes a particularly simple automatic disconnection of the knitting machine when a fault signal is received from the yarn monitoring arrangement on the entry side or the discharge side.

A preferred embodiment of the monitoring circuit of the invention will be described in greater detail with reference to the attached, single FIGURE.

DETAILED DESCRIPTION

The preferred embodiment shows two yarn feeding devices 1, 1'. Each yarn feeding device is associated with a knitting system of a knitting machine (not shown).

Like components of the circuits of the yarn feeding devices are identified with like numerals.

The yarn feeding device 1 has two yarn monitoring means (not shown) which are connected to switches (2, 3). Both switches 2, 3 are respectively grounded with a terminal. The two other terminals of the switches 2, 3 are coupled to the d.c. voltage terminals 5, 9 of a bridge rectifier consisting of four diodes 4, 6, 8, 10. An a.c. voltage terminal 7 of the bridge rectifier is connected to a fault signal line 14. The other a.c. voltage terminal 11 is connected to a supply line 13 across an indicating lamp 12. The supply line is connected to a supply voltage source 15 to 19. The supply voltage source includes an a.c. voltage source 15, two rectifier elements 16, 17 which are of opposite polarity and designed as diodes, as well as a periodically change-over switch 19*a*, 19*b* which may be designed as a flashing relay. One of the two rectifier elements is directly connected to the a.c. voltage source 15. The other rectifier element 17 is in communication with the a.c. voltage source 15 via a manual switch 18. On the output side the two rectifier elements 16, 17 are connected to the two inputs of a flashing relay 19*b* which is operated by a periodically actuated exciting coil 19*a*.

When the manual switch 19 is open, a signal which has only a half-wave series is supplied to the yarn feeding devices 1 via the supply line 13. With such a signal, the monitoring circuit is only responsive to one of the two switches 2, 3. A manual switch of this kind is necessary to selectively disable the outgoing yarn monitoring means which is connected to the switch 3 during transition states of the knitting machine.

During a first interval the change-over switch 19 is in its upwardly pivoted switching position in which positive a.c. voltage half-waves appear on the supply line 13. During a second interval the change-over switch 19 is in its lower switching position in which negative a.c. voltage half-waves are supplied to the supply line 13.

Both the first interval and the second interval are several times the period of the a.c. voltage signal generated by the a.c. voltage source 15.

The fault signal line 14 is connected to a knitting machine locking relay 20*a*, 20*b* whose exciting coil 20*a* is connected to the first and second rectifier elements 16, 17 via third and fourth rectifier elements 21, 22 of opposite polarity.

The circuit member 20*b* of the knitting machine locking relay 20*a*, 20*b* is in series with the motor 23 of the knitting machine.

When none of the two yarn monitoring means is responsive, the switches 2, 3 are open. In this case, the branch point 5 of the bridge rectifier 4, 6, 8, 10 follows the positive signal half-wave which is supplied on the one hand via the second rectifier diode 17, the change-over switch 19, the supply line 13, the indicating lamp 12 and the diode 4 of the bridge rectifier and which is supplied on the other hand via the second rectifier element 17 and the third rectifier element 21, the exciting coil 20*a* of the knitting machine locking relay 20 via the branch point 7 and the diode 6 of the bridge rectifier. The branch point 9 of the bridge rectifier correspondingly follows the negative a.c. voltage half-wave which is supplied on the one hand via the first rectifier element 16, the supply line 13, the indicating lamp 12 and the diode 10 and which is supplied on the other hand via the first rectifier element 16, the fourth rectifier element 22, the exciting coil 20*a* of the knitting machine locking relay 20 via the branch point 7 and the diode 8 of the bridge rectifier.

When the first yarn monitoring means is operated so that the corresponding switch 2 is closed, the branch point 5 is grounded. During the respectively first interval during which the change-over switch 19 is in the upper one of the two positions shown, a current flows across the second rectifier element 17 and the supply line 13 through the indicating lamp 12 and the diode 4 of the bridge rectifier via the branch point 5 toward ground. This has the effect that the indicating lamp emits light during the respectively first interval during which the change-over switch 19 is in the position shown in the figure. Moreover, during the first interval a current flows via the second rectifier element 17 and the third rectifier element 21 through the exciting coil 20*a* of the knitting machine locking relay 20 via the fault signal line 14 to the branch point 7 and via the diode 6 and the branch point 5 to ground. This leads to an operation of the knitting machine locking relay 20 so that the motor 23 of the knitting machine stops.

An operation of the switch 3 leads accordingly to an activation of the indicating lamp 12 and the knitting machine locking relay 20, respectively, during the respectively second interval.

When both switches 2, 3 are closed, the indicating lamp 12 emits light continuously during both the first interval and the second interval, i.e. independently of the change-over position of the change-over switch 19*a*, 19*b*.

The first and second intervals are preferably of different lengths. For instance, the first interval may have a length of 1 sec while the length of the second interval is merely 0.5 sec. An intermittent light with a connection period of one second and a disconnection period of half a second then indicates an actuation of the yarn monitoring means associated with the switch 2 while an intermittent light having a reversed pulse duty factor means an actuation of the yarn monitoring means associated with the switch 3. When the intervals are fixed in such a way, a permanent light corresponds to the simultaneous actuation of both switches.

I claim:

1. A monitoring circuit for a knitting machine, comprising at least one yarn feeding device having two yarn monitoring means provided with two switches, said switches being connected via a first rectifier circuit and an indicating lamp to a supply line connected to a supply voltage source in such a way that when one of said two yarn monitoring means is operated, said indicating lamp is only activated by one half-wave associated with said yarn monitoring means and belonging to an a.c. voltage signal generated by said supply voltage source, the improvement wherein said a.c. voltage signal generated by said supply voltage source comprises first intervals during which said signal has exclusively positive a.c. voltage half-waves and second intervals during which said signal has exclusively negative a.c. voltage half-waves, and said supply voltage source includes an a.c. voltage source, first and second rectifier elements which are of opposite polarity and connected to said a.c. voltage source, and a periodically operated change-over switch which alternately connects said rectifier elements to said supply line.

2. A monitoring circuit according to claim 1, including one of said two rectifier elements being connected to said a.c. voltage source via a manual switch.

3. A monitoring circuit according to claim 1, including a second rectifier circuit connected to said switches, said second rectifier circuit being coupled via a fault signal line to a knitting machine locking relay, said locking relay being connected across third and fourth rectifier elements to said first and second rectifier elements.

4. A monitoring circuit for a knitting machine, comprising:

at least one yarn feeding device, said yarn feeding device including two yarn monitoring means for detecting faults in the yarn feeding device, said yarn monitoring means provided with switches; and a supply voltage source connected to said switches via a rectifier circuit and an indicating lamp, said supply voltage source including signal means for generating a signal which actuates said lamp when at least one said yarn monitoring means detects a fault in said yarn feeding device, said signal having exclusively positive voltage half-waves during first time intervals and having exclusively negative voltage half-waves during second time intervals, said first and second time intervals being of different length.

5. A monitoring circuit according to claim 4, said signal means including an a.c. voltage source, first and second rectifier elements, each of said rectifier elements having a first end connected to said a.c. voltage source and having a second end, respective said ends of said first and second rectifier elements being of opposite polarity.

6. A monitoring circuit according to claim 5, said signal means including switching means for periodically alternatingly connecting said second ends of said rectifier elements to said indicating lamp.

7. A monitoring circuit according to claim 5, including one of said rectifier elements being connected to said a.c. voltage source by a manual switch.

8. A monitoring circuit according to claim 5, including a second rectifier circuit connected to said switches and coupled to a knitting machine locking relay, said locking relay and said first and second rectifier elements having third and fourth rectifier elements connected therebetween.

9. A monitoring circuit according to claim 4, said signal having a plurality of positive voltage half-waves during said first time intervals and having a plurality of negative voltage half-waves during said second time intervals.

10. A monitoring circuit according to claim 4, including said first time intervals having a length of about one second and said second time intervals having a length of about one-half second.

* * * * *